US006865971B2

(12) United States Patent
Ernesti

(10) Patent No.: US 6,865,971 B2
(45) Date of Patent: Mar. 15, 2005

(54) WRENCH STOP

(76) Inventor: Carl J. Ernesti, 116 E. Phillip, Norfork, NE (US) 68701

( * ) Notice: Subject to any disclaimer, the term of this patent is extended or adjusted under 35 U.S.C. 154(b) by 0 days.

(21) Appl. No.: 10/602,768

(22) Filed: Jun. 25, 2003

(65) Prior Publication Data

US 2004/0261587 A1 Dec. 30, 2004

(51) Int. Cl.[7] ..... B25B 13/00
(52) U.S. Cl. ..... 81/124.3; 81/124; 81/121
(58) Field of Search ..... 81/124, 125.1, 81/124.3, 121, 125, 119

(56) References Cited

U.S. PATENT DOCUMENTS 1,635,102 A 7/1927 Watson
2,687,371 A 12/1954 Bowman
2,751,802 A 9/1956 Reuillard
3,731,722 A 5/1973 Carr
4,058,032 A 11/1977 Jacks
4,406,188 A 9/1983 Mills
4,718,316 A * 1/1988 Dedrick ..... 81/125
4,787,273 A 11/1988 Griffith
5,230,263 A * 7/1993 Kwaka ..... 81/125.1
5,307,713 A * 5/1994 White ..... 81/180.1
5,983,758 A 11/1999 Tanner

* cited by examiner

*Primary Examiner*—Joseph J. Hail, III
*Assistant Examiner*—Alvin J Grant
(74) *Attorney, Agent, or Firm*—Richard C. Litman

(57) ABSTRACT

The wrench stop for preventing a gripping end of a wrench from sliding off the lands of a fastener, such as a nut or bolt head. The wrench stop includes a hole through its center so that the wrench stop slides over the shank of a stud or bolt when fastening a nut thereto. The wrench stop may be magnetized to provide positive attachment to the fastener. The wrench stop may be attached to an open-end wrench, a box-end wrench, a combination wrench, a ratcheting box-end wrench, etc.

13 Claims, 6 Drawing Sheets

WRENCH STOP

BACKGROUND OF THE INVENTION

1. Field of the Invention

The present invention relates to wrenches, and more particularly, to a wrench stop for multipoint box-end and open-end wrenches. The wrench stop is a thin circular plate attached to the end of the wrench to prevent the wrench head from slipping off the fastener and to facilitate locating, aligning and positioning the box-end or open-end of the wrench on the bolt head or nut of a fastener being tightened or loosened.

2. Description of the Related Art

Wrenches in general are well known in the art for tightening or loosening fasteners which are often located in odd and difficult to see locations. One problem with existing wrenches is that the positioning and retention of the box-end or open-end wrench upon a fastener can be relatively difficult, particularly when the wrench is used to position the box-end or open-end on a nut of the fastener in restricted locations where the fastener is not easily viewed when the user is attempting to tighten or loosen the nut.

A further problem is that when the bolt head is loosened from the workpiece or the nut is advanced along the threaded bolt shank, the head of the wrench can slip off of the bolt head or nut, sometimes causing the user to skin or bruise the knuckles on the workpiece. In any event, when this occurs, the user must reposition the box-end or open-end of the wrench on the fastener.

In an effort to overcome these deficiencies, there have been numerous attempts to provide a wrench structure that prevents the wrench head from slipping off or past the fastener with subsequent risk of personal injury to knuckles and hands and/or damage to both the wrench and fastener, as well as the consumption of the necessary time in re-positioning the wrench on the fastener when using the wrench.

For example, U.S. Pat. No. 2,697,371, issued Dec. 21, 1954 to Bowman, U.S. Pat. No. 1,635,102, issued Jul. 5, 1927 to Watson, U.S. Pat. No. 4,406,188, issued Sep. 27, 1983 to Mills and U.S. Pat. No. 4,787,273, issued Nov. 29, 1988 to Griffith all describe a sliding member attached to the shank of the wrench which is slid back and forth to engage to the bolt and nut of the fastener. This arrangement is cumbersome, time consuming and not suited for use with wrenches having a non-uniform shank. These devices are not cost effective, and the sliding member may easily be damaged and become unusable after repeated use.

U.S. Pat. No. 5,983,758, issued Nov. 16, 1999 to Tanner, describes an integral stopper located in alternating triangular areas along the circumference within the gripping portion of a socket near the shoulder to prevent slippage of the wrench past the fastener.

U.S. Pat. No. 3,731,722, issued May 8, 1973 to Carr, describes the use of an adjustable, magnetized ringlet with a radial split inserted within the bore of a wrench gripping member, and/or use of a bendable H-shaped strip for holding the ringlet on the top of the box-end of a wrench.

U.S. Pat. No. 2,751,802, issued Jun. 26, 1956 to Reuillard, describes a pivotal metal strip attached to a socket head for frictionally retaining the socket against the nut.

U.S. Pat. No. 4,058,032, issued Nov. 15, 1977 to Jacks, describes an open-end wrench provided with a resilient insert means, such as a spring wire clip, inserted into the jaw for frictionally engaging the nut of a fastener.

None of the above inventions and patents, taken either singly or in combination, is seen to describe the instant invention as claimed. Thus a wrench stop solving the aforementioned problems is desired.

SUMMARY OF THE INVENTION

The wrench stop is an attachment for wrenches which aids in aligning the wrench over a fastener and also maintains the wrench in the engaging position on a bolt or nut, thereby greatly facilitating and expediting the tightening or removal of the nut. The wrench stop is a rigid disk or circular plate adapted for attachment to the end of the wrench. The plate has a hole defined through the center of the disk dimensioned so that the shank of a bolt can pass through the hole. The plate is placed on one side of the jaws of an open end wrench, or on one side of box end or ratchet, so that the wrench end can be fitted over a bolt head or nut, but the plate stops the bolt head or nut from passing completely through the jaws, box end, or ratchet.

When used to fasten a nut on a stud or the shank of a bolt, the circular hole keeps the wrench end positioned over the shank. The wrench stop may be magnetized in order to keep the wrench stop positively engaged with the fastener.

In another embodiment, the wrench stop may comprise a thin plate having a U-shaped slot defined therein which is attached to an open end wrench. The plate may be fixed to the jaws of the wrench, or the plate may be made of magnetic material for removable attachment to the jaws of the wrench. The plate is attached to the end of the wrench with the U-shaped slot in alignment with the U-shaped jaws, but narrowing the opening defined by the jaws on one side of the wrench, so that the jaws engage the fastener, but the wrench is prevented from sliding downward off the fastener by the plate. The slot is dimensioned so that the shank of a bolt or stud is slidable into the slot, but the nut or head of the bolt is not. The plate may be circular or U-shaped. In a combination wrench, a disk-shaped wrench stop with the circular opening defined therein may be attached to the box end, and a plate having the U-shaped slot defined therein may be attached to the open end.

Accordingly, it is a principal object of the invention to facilitate the tightening and removal of the nuts from a fastener located in a restricted area, which is not easily viewed, by providing a wrench stop having a circular plate with a center hole defined therein over one side of the wrench end so that the plate can slide over the exposed portion of a stud or bolt shank.

It is another object of the invention to provide a wrench stop with magnetic property in order to retain the nut or bolt head in the socket grip by positive engagement.

It is another object of the invention to prevent a wrench from sliding off a bolt head, nut, or other fastener by providing a wrench stop which prevents the fastener from passing completely through the end of the wrench.

Still another object of the invention is to provide a wrench stop for an open end wrench as a thin plate attached to the jaws of the open end wrench, the plate having a U-shaped slot therein permitting the shank of a bolt or stud to slide in the slot, but preventing the jaws of the wrench from sliding downward and off a fastener or bolt head attached to the shank or stud.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
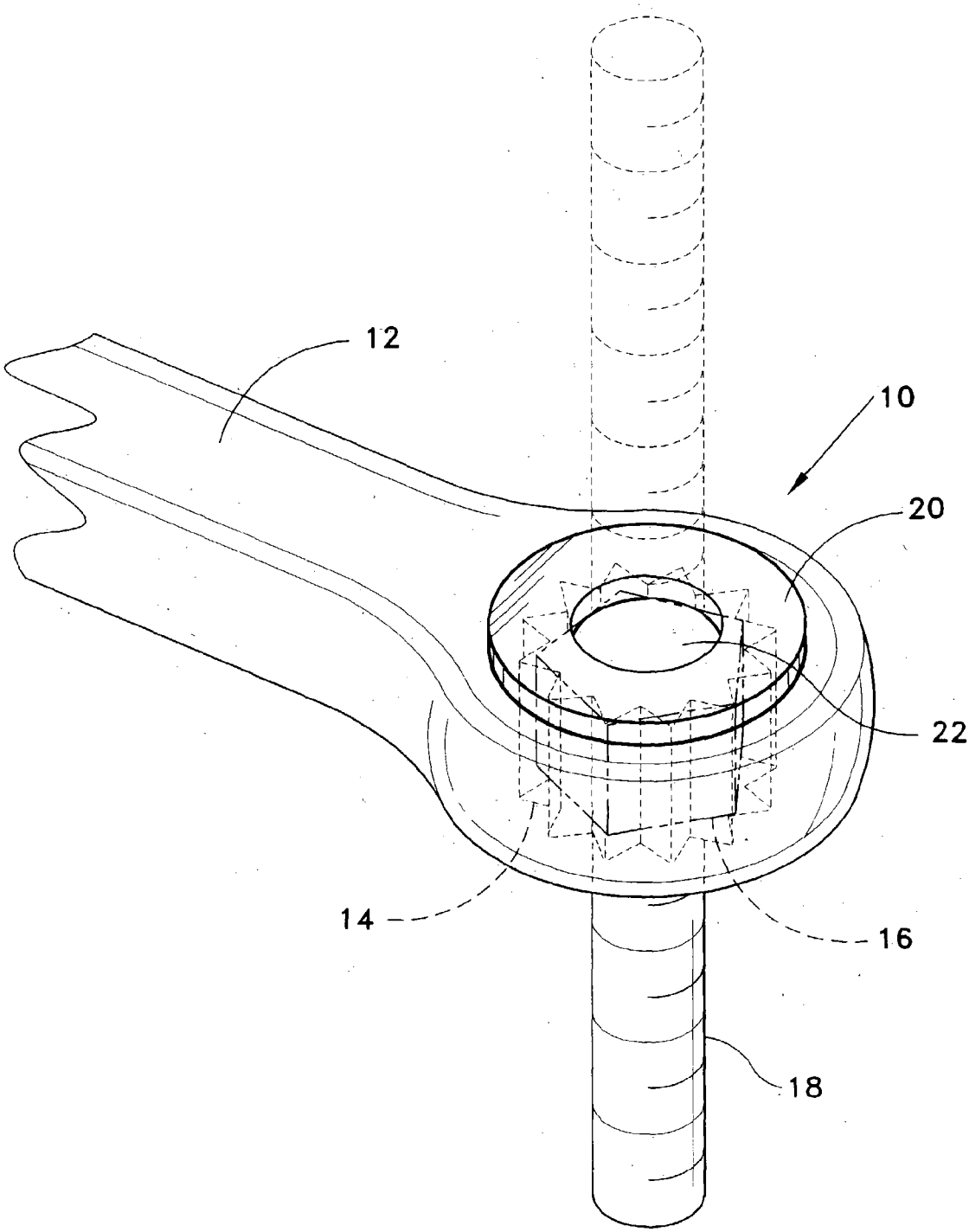
FIG. 1 is an environmental, perspective view of a wrench stop according to the present invention.

The present invention is a wrench stop, designated as 10 in the drawings, as illustrated in FIGS. 1-5. Wrench stop 10 comprises a circular plate 20 having a central hole 22. The size of the central hole 22 is slightly greater than the size of the bolt shank or stud 18 on which a nut is being tightened or loosened. Wrench stop 10 may be metallic or non-metallic, and is formed of a thin, rigid sheet of material. The central hole 22 snuggly fits over the bolt 18 and assists in aligning, locating and engaging the wrench grip 14 or 26 over the nut 16 of the fastener being loosened or tightened, as illustrated in FIG. 1.

FIG. 1 is a perspective view of the invention, which shows the general features of the invention. The wrench 12 has a box-end provided with a wrench stop 10 comprising a plate 20 attached on one side of the head. The plate 20 has a central hole 22 with a diameter slightly greater than the diameter of the shank of the bolt 18. The diameter of the plate 20 is greater than the diameter of the box-end 14, but less than the outside dimension of the box-end of the wrench. The plate 20 may be attached to the wrench 12 by welding or chemical adhesive.

Figure 2:
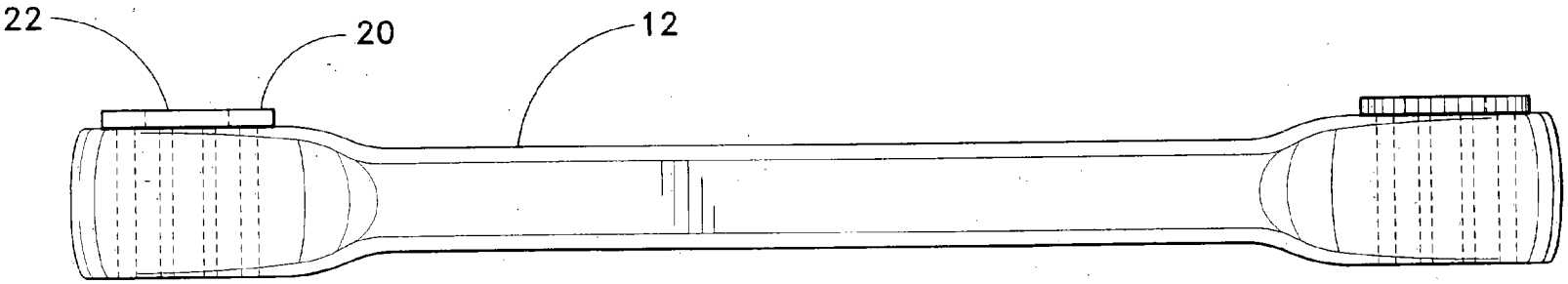
FIG. 2 is a side view of a double box-end wrench with a wrench stop according to the present invention attached at each end.

FIG. 2 shows a side view of a double box-end wrench 12 with wrench stops 10. The plate 20 of the wrench stop 10 is attached on one side of the wrench head, so as not to interfere with the operation of the wrench.

Figure 3:
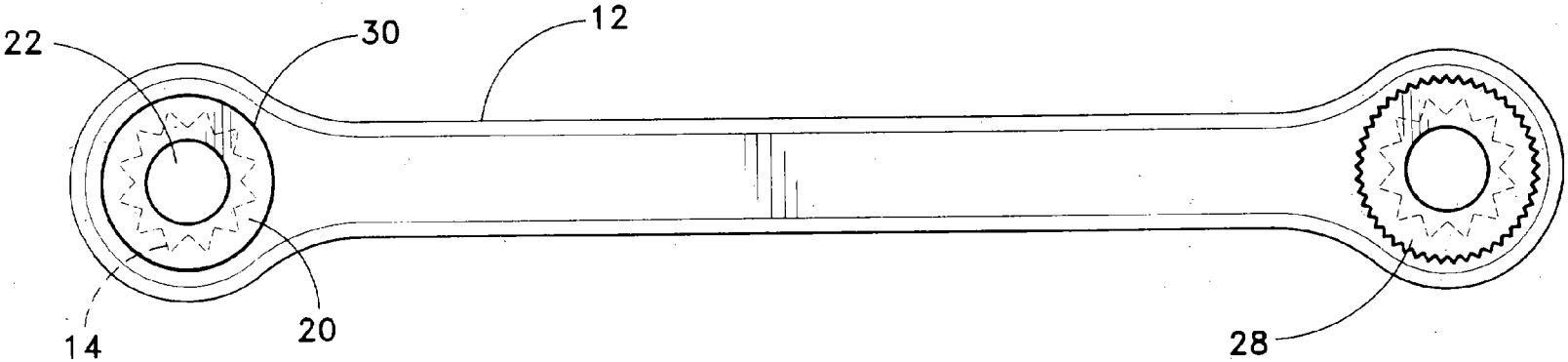
FIG. 3 is plan view of a double box-end wrench with a wrench stop attached at each end, one end with a serrated edge plate and the other end with a smooth edge plate.

FIG. 3 shows a plan view of a double box-end wrench 12 having wrench stops 10 attached at each box-end. Two embodiments of wrench stops 10 are shown. One wrench stop 10 is shown having a plate 20 with serrated edge 28 and the other wrench stop 10 is shown having a plate 20 with smooth edge 30. The outside diameter of the plate 20 is greater than the inner diameter of the box-end 14 but less than the outside dimension of the box-end 14. The plate 20 is provided with a central hole 22 having a diameter slightly larger than the diameter of the shank of a bolt sized to receive a nut which the wrench head is designed to fasten. The central hole 22 is aligned so that the hole 22 is co-axial with the centerline of the wrench head.

Figure 4:
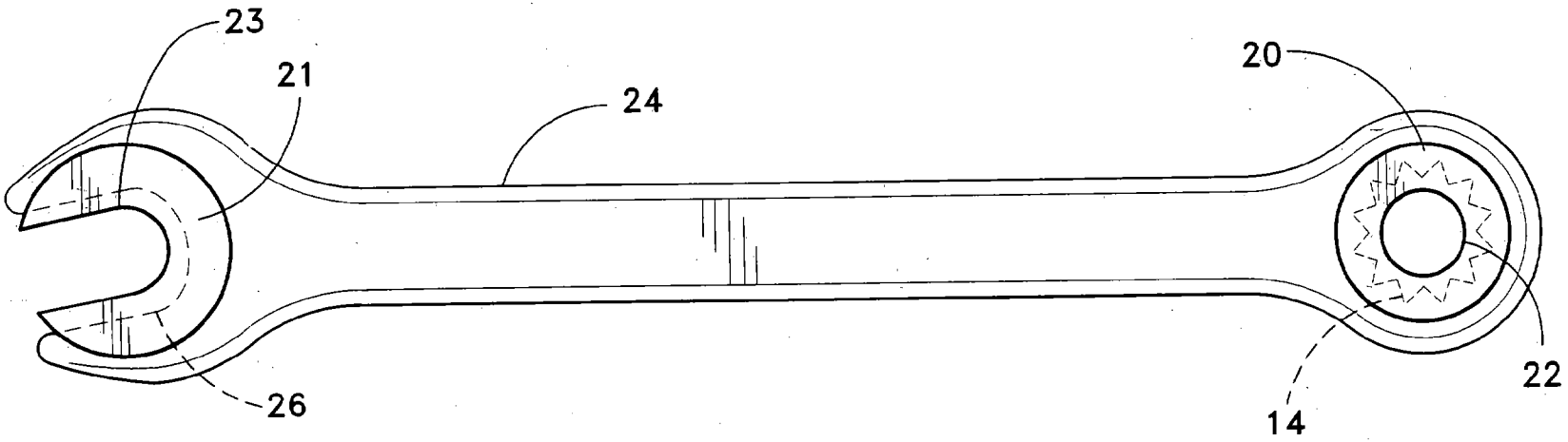
FIG. 4 is a plan view of a combination wrench with a wrench stop according to the present invention attached at each end.

FIG. 4, shows a plan view of a combination wrench 24 having an open-end 26 at one end with a plate 21 of wrench stop 10 attached thereto and a box-end 14 at the other end with a plate 20 of wrench stop 10 attached thereto. The plate 20 at the box end 14 is as described above, being a circular plate 20 provided with a central hole 22 having a diameter slightly larger than the diameter of the shank of a stud or bolt on which a nut is being loosened or tightened. However, plate 21 attached at the open end 26 of the wrench 24 is U-shaped, having a slot 23 defined therein which is narrower than the U-shaped opening formed by the jaws of the open end 26. The plate 21 may be circular with the U-shaped slot defined therein, or may be U-shaped. The slot 23 is wide enough to permit the shank of a bolt or stud to slide to the slot 23, but is narrower than the open end 26 of the wrench 24, so that the wrench stop 10 prevents the jaws of the open end 26 from sliding downward on the lands of a nut or bolt head, so that the open end 26 does not slide off the fastener.

Figure 5:
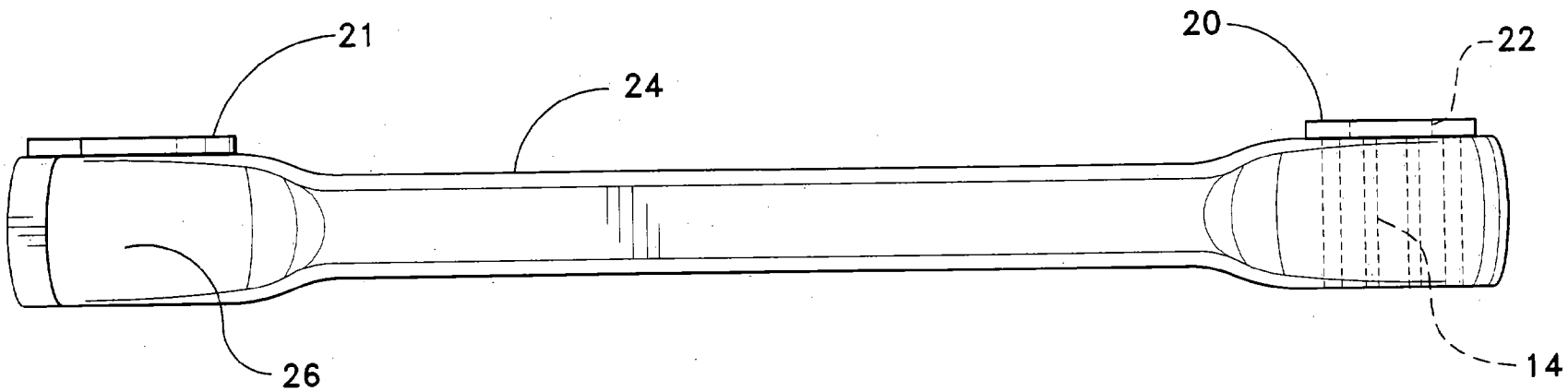
FIG. 5 is a side view of the combination wrench of FIG. 4.

FIG. 5 shows a side view of the combination wrench 24 of FIG. 4. The side view clearly shows that the wrench stops are only attached to one side of the wrench 24.

According to the first embodiment of the present invention, the wrench stop 10 is permanently affixed to the wrench by any conventionally known method, including forging, casting, welding, adhesive bonding by epoxy or other resins, etc. In a ratcheting box-end wrench, the wrench stop 10 may be attached to the wrench head, or to the ratchet gear. The wrench stop 10 may be made from a magnetized ferromagnetic material, such as steel, or from a hard, rigid, plastic material having magnetized particles embedded therein, or the wrench stop 10 may have an inlay of magnetized material interposed between the stop 10 and the wrench head. The plate 20 has a thickness preferably in the range of 1/16" to ¼" thick.

Figure 6:
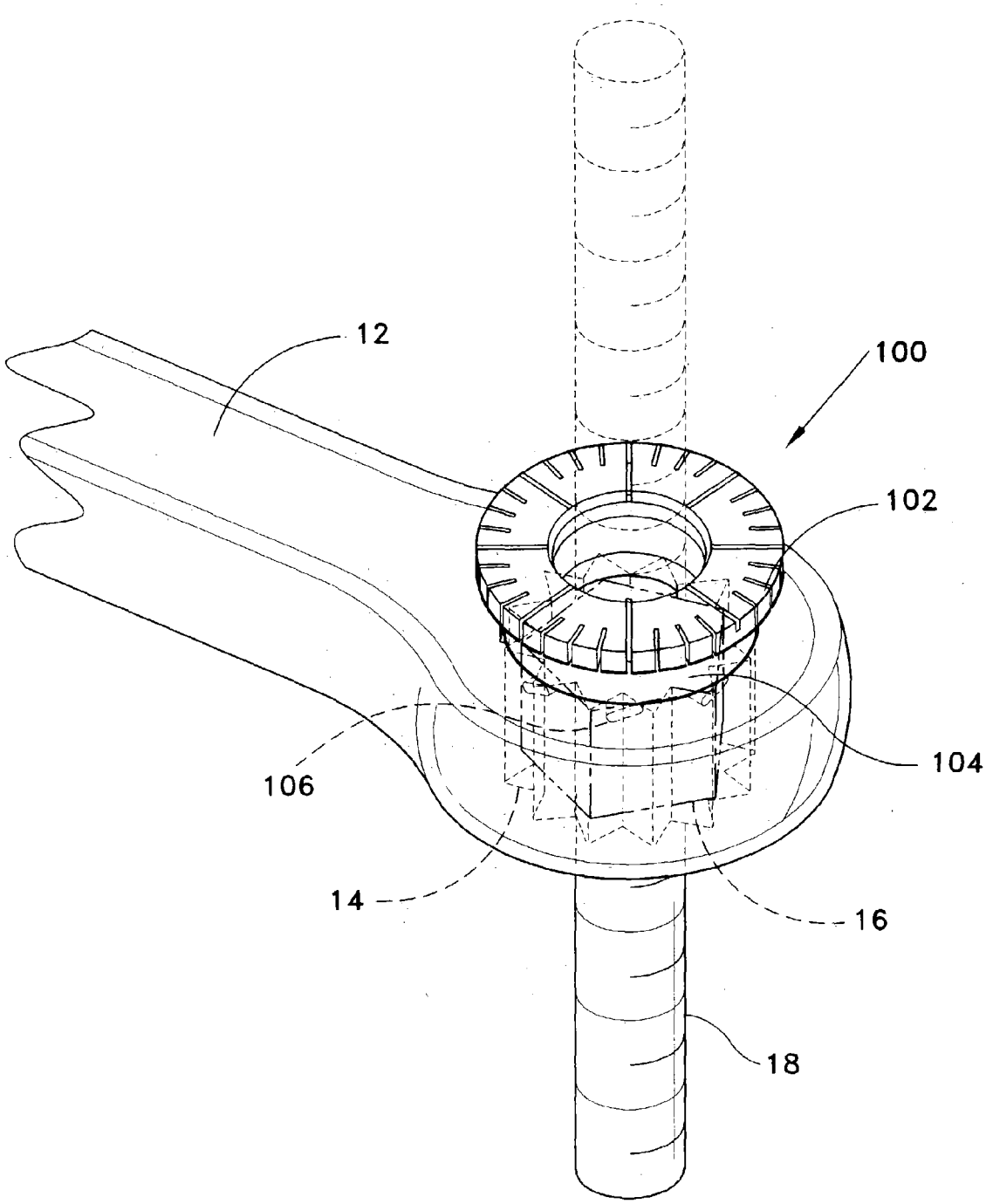
FIG. 6 is a perspective view of a wrench equipped with a wrench stop according to a second embodiment of the present invention.
Figure 8:
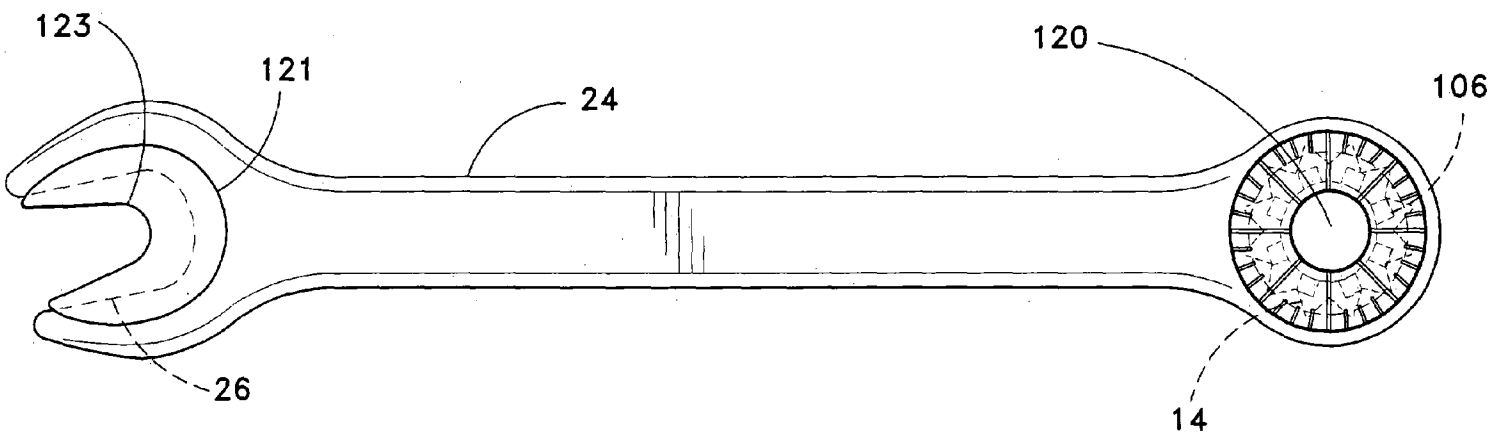
FIG. 8 is a top plan view of a combination wrench having a wrench stop according to the second embodiment of the present invention attached at each end of the wrench.

FIG. 6 shows another embodiment of the present invention designated as 100. The wrench stop 100 is magnetic, and shown removably attached to the box end 14 of a wrench 12 in FIG. 6. In a box end wrench, the wrench stop 100 comprises a top plate 102 with serrated edges, and a magnet 104 sandwiched between the top plate 102 and a bottom toothed plate 106: The top plate 102, the magnet 104 and the bottom plate 106 are joined together centrally and form a one-piece assembly. The outer diameter of the top plate 102 is greater than the outer diameter of the magnet 104; the outer diameter of the magnet 104 is slightly greater than the diameter of the box-end 14 at the gripping end of the wrench 12; and the outer diameter of the toothed bottom plate 106 is slightly less than the box-end 14 at the gripping end of the wrench 12 for removably locking into the box-end 14 of the gripping end of the wrench 12. Referring to FIGS. 6 and 8, the one-piece assembly 100 is provided with a central hole 120 having a diameter slightly larger than the diameter of the shank of a stud or bolt 18 on which a nut 16 is being loosened or tightened. The bottom toothed plate 106 is about 1/16" thick and removably attaches to the top portion of the box-end 14 at the gripping end of the wrench 12. Note, the bottom toothed plate 106 is circular for removably attaching to a box-end of a wrench, or is oval shaped for removably attaching to an open end wrench.

Figure 7B:
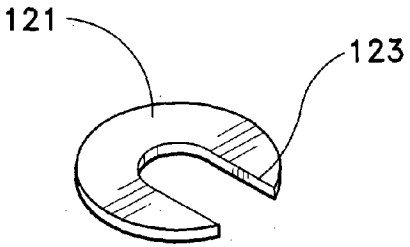
FIG. 7B is a perspective view of the second embodiment of a wrench stop according to the present invention for attachment to an open end wrench.
Figure 7A:
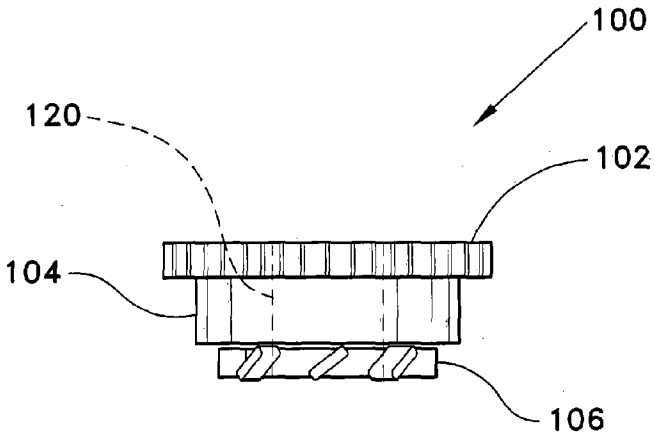
FIG. 7A is a side view of the second embodiment of a wrench stop according to the present invention for attachment to a box end wrench.

FIG. 7A shows an elevation view of the wrench stop 100, illustrating the top plate 102, magnet 104 and bottom plate 106 joined together.

FIG. 7B shows a removable wrench stop for an open end wrench. The removable wrench stop for an open end wrench is a thin magentic plate 121 having a U-shaped slot 123 defined therein. The magnetic plate 121 is removably attached to the jaws of an open end wrench or combination wrench with the slot 123 aligned with the jaws of the wrench. The slot 123 is narrower in width than the opening defined by the jaws of the wrench. The slot 123 is wide enough to slide over the shank of a bolt or stud, but wide enough that it does not slide over the nut or bolt head of a fastener, so that the wrench stop prevents the open end wrench from sliding downward and off the fastener.

FIG. 8 shows a plan view of a combination wrench 24 having an open gripping end 26 at one end and a closed gripping end 14 at the other end, with a wrench stop 100 attached to the box end 14 and open end 26, respectively, by magnetic attraction.

Figure 9:
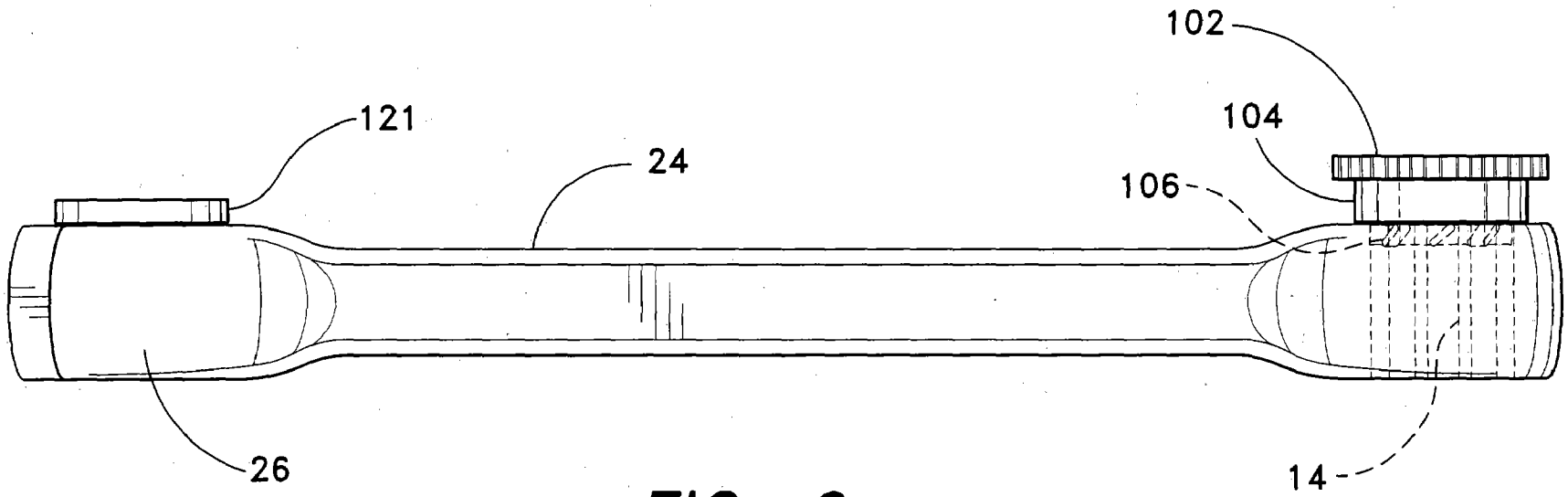
FIG. 9 is a side elevation view of the combination wrench shown in FIG. 8.

FIG. 9 shows a side elevation view of the combination wrench 24 having an open gripping end 26 at one end and a closed gripping end 14 at the other end with the wrench stop 100 attached to the respective ends of the wrench 24.

According to the second embodiment of the present invention, the wrench stop 100 is an integral unit which is removably attached to either side of the gripping end of a wrench before using the wrench for loosening or tightening a nut, the wrench stop 100 being held in place by magnetism.

It is to be understood that the present invention is not limited to the embodiments described above, but encompasses any and all embodiments within the scope of the following claims.

I claim:

1. In combination, a wrench and a wrench stop, comprising:

an elongated shank having at least one gripping end having opposing sides, the gripping end being adapted for gripping a fastener, the shank being turned in order to apply torque for tightening and loosening the fastener;

a rigid circular plate removably attached to one of the opposing sides of the gripping end in order to prevent the gripping end from slipping past the fastener, said plate having a hole defined through the center of said plate adapted for extending around a shank of a bolt or stud; and a toothed ring coupled to said rigid circular plate, said toothed ring having a diameter smaller than said circular plate and defining a hole aligned with the hole of said circular plate;

wherein said circular plate is magnetized.

2. The wrench and the wrench stop according to claim 1, wherein the gripping end comprises a U-shaped pair of jaws defining an open end wrench, said circular plate being attached to both jaws across the open end of the wrench, the diameter of the hole defined in the center of said plate being less than the width of the U-shaped opening defined by said jaws, whereby said jaws are prevented from sliding off lands defined on said fastener.

3. The wrench and the wrench stop according to claim 1, wherein the gripping end comprises a closed loop having internal gripping teeth defining a box end wrench, said circular plate being attached across the loop, the diameter of the hole defined in the center of said plate being less than the diameter of the loop, the circular plate and the loop being coaxially aligned, whereby the box end is prevented from sliding off said fastener, and said toothed ring being adapted for engaging the internal gripping teeth in the box end wrench in order to prevent rotation of the wrench stop with the gripping end of the wrench.

4. The wrench and the wrench stop according to claim 1, wherein the gripping end comprises a closed loop having a ratcheting gear with internal gripping teeth defining a ratcheting box end wrench, said circular plate being attached across the loop, the diameter of the hole defined in the center of said plate being less than the diameter of the loop, the circular plate and the loop being coaxially aligned, whereby the ratcheting box end is prevented from sliding off said fastener, and said toothed ring being adapted for engaging the internal gripping teeth in the ratcheting box end wrench in order to prevent rotation of the wrench stop with the gripping end of the wrench.

5. The wrench and the wrench stop according to claim 1, wherein said circular plate is made from metal.

6. The wrench and the wrench stop according to claim 1, wherein said circular plate is made from plastic.

7. The wrench and the wrench stop according to claim 1, wherein said at least one gripping end comprises a first gripping end having a U-shaped pair of jaws defining an open end and a second gripping end having a closed loop with internal gripping teeth defining a box end, whereby said shank defined a combination wrench, said rigid circular plate comprising a first circular plate selectively attached to said first end and a second circular plate selectively attached to said second end.

8. The wrench and the wrench stop according to claim 1, wherein said circular plate has a serrated edge.

9. The wrench and the wrench stop according claim 1, wherein said circular plate has a smooth edge.

10. The wrench and the wrench stop according to claim 1, wherein said circular plate has a thickness between about one-sixteenth and one-quarter inches.

11. A wrench stop, comprising:

a circular plate having a hole defined therein;

an annular magnet permanently affixed to the circular plate, the magnet defining a hole aligned with the hole in said circular plate, said circular plate having a serrated periphery for ease in grasping the wrench stop;

a toothed ring attached to said annular magnet;

whereby the plate being adapted for selective attachment across a gripping end of a wrench, the hole being adapted for extending around a shank of a bolt or stud in order to prevent the wrench from disengaging from the bolt or stud, and the wrench stop is adapted for attachment to the gripping end of the wrench by magnetic attraction.

12. The wrench stop according to claim 11, wherein the toothed ring having a diameter smaller than said annular magnet, the toothed ring being adapted for engaging internal teeth in a box end wrench in order to prevent rotation of the wrench stop with the gripping end of the wrench.

13. The wrench and the wrench stop according to claim 1, further comprising an annular magnet permanently affixed between said circular plate and said toothed ring, the magnet defining a hole aligned with the hole in said circular plate and said toothed ring;

whereby the wrench stop is adapted for selective attachment to the gripping end of the wrench by magnetic attraction.

* * * * *